US005873958A

United States Patent [19]

Makii et al.

[11] Patent Number: 5,873,958

[45] Date of Patent: Feb. 23, 1999

[54] HIGH STRENGTH AND HIGH TOUGHNESS STEEL WIRES AND METHOD FOR MAKING THE SAME

[75] Inventors: Koichi Makii; Hiroshi Yaguchi; Nobuhiko Ibaraki, all of Kobe; Takaaki Minamida, Kakogawa; Masato Kaiso, Kobe, all of Japan

[73] Assignee: Kabushiki Kaisha Kobe Seiko Sho, Kobe, Japan

[21] Appl. No.: 921,517

[22] Filed: Sep. 2, 1997

[30] Foreign Application Priority Data

Sep. 2, 1996 [JP] Japan ..... 8-232287
Mar. 31, 1997 [JP] Japan ..... 9-081324

[51] Int. Cl.[6] ..... C22C 38/18; C22C 38/00

[52] U.S. Cl. ..... 148/403; 148/595

[58] Field of Search ..... 148/403, 595

[56] References Cited

U.S. PATENT DOCUMENTS 5,211,772 5/1993 Ashida et al. .

5,575,866 11/1996 Minamida et al. .

FOREIGN PATENT DOCUMENTS 3425394 1/1985 Germany ..... 148/403
8-120407 5/1996 Japan .

*Primary Examiner*—Deborah Yee
*Attorney, Agent, or Firm*—Oblon, Spivak, McClelland, Maier & Neustadt, P.C.

[57] ABSTRACT

A steel wire is composed mainly of fine pearlite and/or coarse pearlite, where the lamellar cementite in the pearlite is amorphous or amorphous-like. Alternatively, the wire may be composed mainly of bainite, where the cementite in the bainite is amorphous or amorphous-like. To manufacture the steel wire, a starting steel product is subjected repeatedly to patenting and cold drawing, and then subjected to final drawing at a true strain of 2.0 or above while cooling. The steel wire is higher in strength and toughness than wire whose lamellar cementite consists of nano crystals. The steel wire does not suffer any delamination when subjected to torsion.

10 Claims, 5 Drawing Sheets

HIGH STRENGTH AND HIGH TOUGHNESS STEEL WIRES AND METHOD FOR MAKING THE SAME

BACKGROUND OF THE INVENTION

1. Field of the Invention

This invention relates to medium to high carbon steel wires (content of C: 0.4 to 1.3%) which become products as cold worked without undergoing any further thermal treatments such as bluing and more particularly, to high strength and high toughness steel wires suitable as steel cord wires, wire saws, PC steel wire ropes and the like and also to a method for making the same.

2. Description of the Prior Art

For the manufacture of steel wires used as steel cord wires and various types of steel ropes, it is usual to subject a high carbon steel wire product to patenting, followed by drawing. Especially, cold drawing enables one to obtain a high strength steel wire. However, if the strength becomes too high as a result of the drawing, delamination may occur, accompanied by poor ductility and toughness. Thus, limitation is placed on the manufacture of high strength steel wires through drawing.

Under these circumstances, we made studies from the crystallographic standpoint at a level of nanometers for the purpose of developing high strength, high toughness and high ductility steel wires. As a result, it was found that by appropriately controlling cold working conditions and annealing conditions, carbides of a steel wire composed mainly of pearlite or bainite were successfully changed into cementite crystals whose diameter was on the order of nanometers (nm) (hereinafter referred to simply as "nano crystals"). It was also found that steel wires which had lamellar cementite consisting of the nano crystals as a carbide in the structure exhibited high strength, high toughness and high ductility. Our earlier Japanese Laid-open Patent Application 8-120407 was based on the above findings.

It will be noted that the interrelation between the plastic deformability of pearlite and the lamellar space has been known prior to the filing of the above-mentioned application. In the field of very fine wires such as steel cord wires, any technique of evaluating the state of existence of lamellar cementite has never been established. The relations between the existing form of cementite and the mechanical properties are not known in many respects. It is merely known from the experimental results of changing constituent compositions and preparation conditions according to the rule of trial and error that where the structure obtained after patenting consists of a fine, uniform pearlite structure, mechanical properties are good.

We have developed a steel wire wherein the crystal structure of lamellar cementite consists of nano crystals (which steel wire may be sometimes referred to simply as a nano crystal steel wire hereinafter) and can thus provide a high strength, high toughness and high ductility steel wire. It should be noted that there has been a demand for a steel wire having better mechanical characteristics and that developments of a steel wire which is high in strength and excellent in ductility have been expected.

SUMMARY OF THE INVENTION

It is an object of the invention to provide a high strength and high toughness steel wire which has better mechanical properties than nano crystal steel wires.

It is another object of the invention to provide a high strength and high toughness steel wire which is higher in strength and better in toughness than those wires whose lamellar cementite consists of nano crystals and which does not suffer any delamination when subjected to torsion.

It is a further object of the invention to provide a method for making a high strength and high toughness steel wire of the type mentioned above.

According to one embodiment of the invention, there is provided a steel wire which comprises fine pearlite and/or coarse pearlite as a main component, wherein lamellar cementite in the structure is amorphous or amorphous-like. Alternatively, if the steel wire is mainly composed of bainite, cementite in the structure should be amorphous or amorphous-like.

Whether or not the lamellar cementite or cementite in the structure is amorphous or amorphous-like can be confirmed according to the following three methods (1) to (3).

(1) Method based on observation through transmission electron microscopy

In case where when a diffraction pattern is taken at a beam diameter of 1 nm or below, a halo pattern is shown and any crystallinity cannot be confirmed on review of a lattice image, the lamellar cementite or cementite is judged or defined as "amorphous" or "amorphous-like".

(2) Method based on the Mössbauer spectroscopy

In the Mössbauer spectra of lamellar cementite or cementite, when a maximum value among peaks exhibiting a ferromagnetic component is taken as Pf and a maximum value among peaks exhibiting a superparamagnetic component is taken as Psp, to satisfy the relation of $Pf<Psp$ is judged as "amorphous" or "amorphous-like".

(3) Method using X-ray diffraction analysis

In the X-ray diffraction pattern of lamellar cementite or cementite, the half width ($2\theta$) of a maximum peak of 3 rad., or above is judged as "amorphous" or "amorphous-like".

For the manufacture of steel wires wherein lamellar cementite or cementite in the structure is amorphous or amorphous-like in nature, it is preferred to adopt a method which comprises repeating patenting and cold drawing plural times, wherein a final drawing step is performed while cooling so that a true strain has a value of 2.0 or above.

With the steel wire of the invention, the main structure may consist of a fine pearlite structure and/or a coarse pearlite structure, or a bainite structure provided that lamellar cementite or cementite is amorphous or amorphous-like. For convenience's sake, steel wires where lamellar cementite in the pearlite structure is amorphous or amorphous-like is described in the embodiments of the invention.

PREFERRED EMBODIMENTS OF THE INVENTION

Figure 1A:
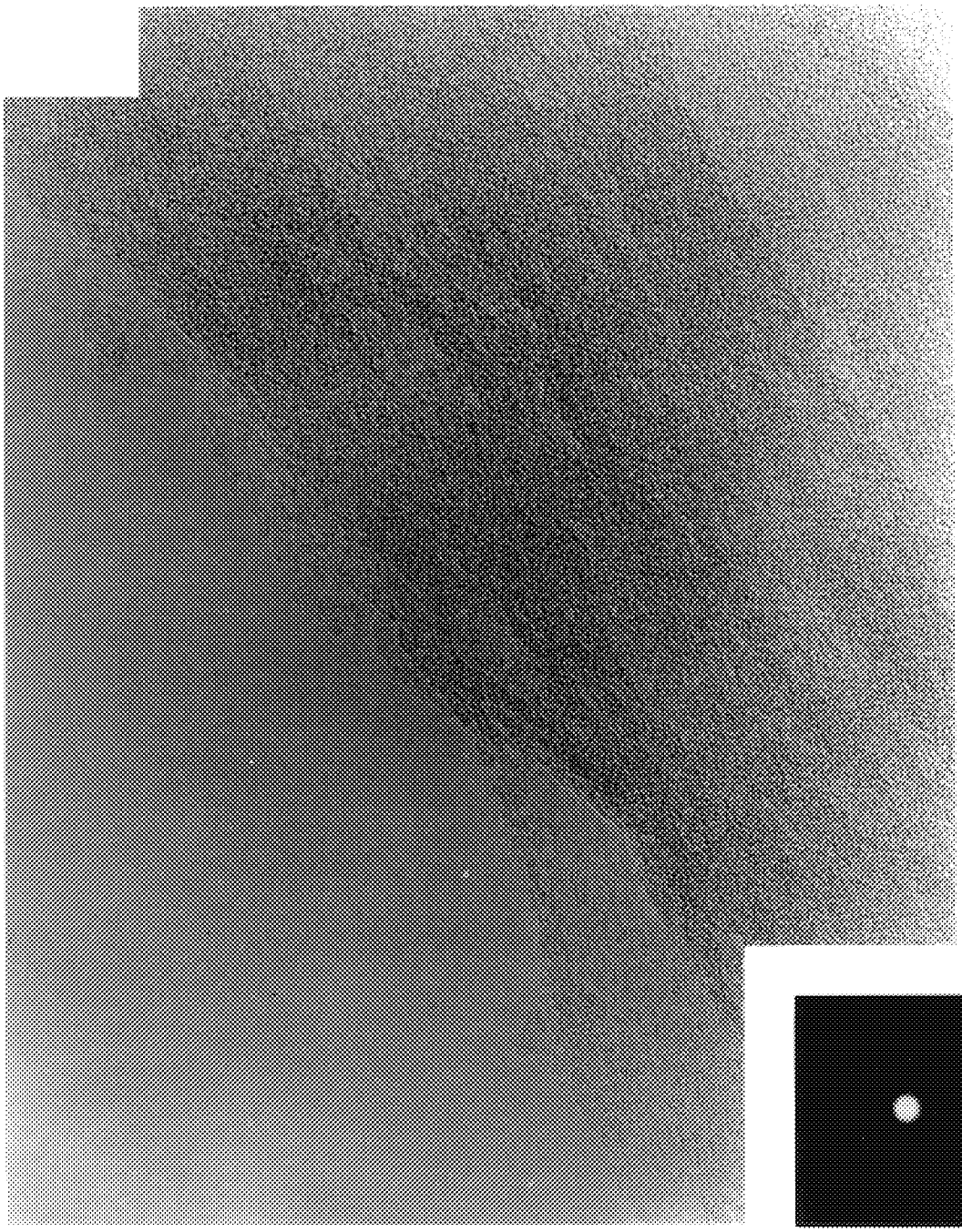
In FIGS. 1, (*a*) and (*b*) are, respectively, images showing crystal structures of wire products obtained according to the invention wherein (*a*) is a TEM image showing a crystal lattice image of lamellar cementite obtained by electrolytic extraction and (*b*) is an electron beam diffraction image showing a diffraction pattern taken by a nano probe (a radius of the electron beam: 1.0 nm)

If the substructure of cementite is present as an aggregate of nano crystals, its deformability is influenced depending on the form of a superfine structure of carbide, aside from the type and amount of additive elements. We have first succeeded in amorphization of lamellar cementite (i.e. amorphization means to render the lamellar cementite amorphous or amorphous-like herein and whenever it appears hereinafter), with its characteristic properties being studied. As a result, it has been found that such amorphized lamellar cementite has hitherto unknown excellent mechanical properties. The invention is accomplished based on this finding.

The mechanical characteristics expected in the present invention are those properties including high strength, high toughness and the incapability of causing any longitudinal crack at the time of torsion, called delamination. Even if the strength is very high, it is not desirable that toughness be low and some delaminations be developed at the time of torsion. Likewise, even if toughness is excellent, low strength is not desirable. More particularly, it is required that strength and toughness be well balanced and excellent without causing any delamination. In the practice of the invention, a parameter of [tensile strength (MPa)]×([reduction of area (%)]+[torsion number]) (hereinafter indicated by TS×(RA+TN)) is used as an index showing a mechanical characteristic. We have ascertained that there is a very high interrelation between the mechanical characteristic expressed by the above index and the crystal state and that when lamellar cementite is amorphized, the mechanical characteristic increases irrespective of the chemical composition of a steel wire (i.e. irrespective of the presence of elements such as Cr added for the purpose of improving other required characteristics). In addition, when strength is increased to such an extent that a delamination would be developed when using nano crystal steel wires, the resultant wire product does not suffer any delamination with its toughness being excellent.

In order to achieve amorphization, it is important to appropriately control working conditions in the drawing step. Table 1 shows the relation between the degree of strain caused by drawing and the crystal structure of lamellar cementite when a 0.88C-0.2Si-0.5Mn-0.004P-0.003S steel is subjected to wet or dry continuous drawing.

TABLE 1

| | Wire Size Prior to Final Drawing (mm) | True Strain | Cooling at the Time of Drawing | Crystal Structure of Lamellar Cementite |
|---|---|---|---|---|
| 1 | 2.0 | 4.61 | no | nano crystals |
| 2 | 1.5 | 4.03 | no | nano crystals |
| 3 | 1.2 | 3.58 | no | nano crystals |
| 4 | 1.0 | 3.22 | no | nano crystals |
| 5 | 0.8 | 2.77 | no | nano crystals |
| 6 | 0.6 | 2.20 | no | nano crystals |
| 7 | 0.5 | 1.83 | no | nano crystals |
| 8 | 0.4 | 1.39 | no | nano crystals |
| 9 | 0.3 | 0.81 | no | nano crystals |
| 10 | 2.0 | 4.61 | yes | amorphous or amorphous-like |
| 11 | 1.5 | 4.03 | yes | amorphous or amorphous-like |
| 12 | 1.2 | 3.58 | yes | amorphous or amorphous-like |
| 13 | 1.0 | 3.22 | yes | amorphous or amorphous-like |
| 14 | 0.8 | 2.77 | yes | amorphous or amorphous-like |
| 15 | 0.6 | 2.20 | yes | amorphous or amorphous-like |
| 16 | 0.5 | 1.83 | yes | nano crystals |
| 17 | 0.4 | 1.39 | yes | nano crystals |
| 18 | 0.3 | 0.81 | yes | nano crystals |

(All wires have an initial size of 5.5 mm and a final size of 0.22 mm.)

The lamellar cementite (strain by drawing: 0) of an as-patented steel wire is in the form of a single crystal. It will be seen that where a wire is drawn without cooling, the true strain ranges from 4.61 to 0.81, in which case lamellar cementite remains as nano crystals without amorphization. Amorphization is possible by cooling at the time of cold rolling. Nevertheless, when the true strain is smaller than 2.0, cementite becomes nano crystals without amorphization. Accordingly, it will be apparent that cold drawing at a true strain of 2.0 or above is necessary for the amorphization.

The reason why amorphization does not proceed even at a true strain of 2.0 or above unless cold drawing is performed is considered due to the fact that if not cooled, the temperature in the vicinity of final dies increases during the course of drawing and a wire product is eventually heated to about 300° C. which is a recovery temperature of cementite. More particularly, where the temperature of a wire product increases owing to the generation of heat by friction or through working during the drawing, once amorphized lamellar cementite may be recrystallized. Accordingly, it is important to appropriately control drawing conditions, under which the temperature of a wire product being drawn does not increase. For instance, it is favorable to air cool the wire product at a drawing speed which is not so high, or to subject the wire to wet drawing. It will be noted that although amorphization is possible according to a method wherein drawing is effected without cooling but at a low drawing speed, it will be necessary to prevent a temperature rise in final dies and to control a reduction of area so as to suppress the temperature rise of the wire. From the standpoint of productivity, it is preferred to adopt cold drawing.

As having discussed hereinbefore, whether or not lamellar cementite or cementite is amorphous or amorphous-like can be confirmed according to (1) a transmission electron microscopic observation method, (2) a Mössbauer spectroscopy, and (3) an X-ray diffraction analysis. These methods are more particularly described below.

(1) Transmission electron microscopic observation method

In the transmission electron microscopic observation, the fact that a halo pattern is shown when a diffraction pattern is taken at a beam diameter of 1 nm or below and no crystallinity can be confirmed on review of a lattice image is sufficient to judge or determine lamellar cementite or cementite as being amorphous or amorphous-like.

The reason why the diffraction pattern is taken at a beam diameter of 1 nm or below is that where a diffraction pattern is taken using an ordinary beam diameter exceeding 1 nm (e.g. a beam on the order of submicrons), not only amorphous, but also nano crystals do not exhibit a ring pattern, but a halo pattern as a diffraction pattern. Nano crystals show a ring pattern when a diffraction pattern is taken at a beam diameter smaller than the size of the nano crystals. Accordingly, to obtain a halo pattern gives evidence that lamellar cementite or cementite is amorphous or amorphous-like.

The transmission electron microscope (TEM) used should be high-resolution TEM, typical of which is a FE-(field emission) TEM. With conventional TEM, the beam is broad (exceeding 1 nm). If a lattice image is observed through such a TEM, any clear lattice image pattern is not obtained. Additionally, nano crystals exhibit a halo pattern when a diffraction pattern is taken. In this way, an amorphous or amorphous-like structure can be confirmed only through observation of a lattice image pattern taken at a beam diameter of 1 nm or below by use of a high-resolution TEM such as FE-TEM.

Figure 1B:
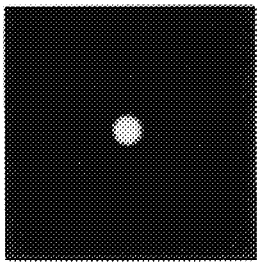

In FIG. 1, (*a*) is an image taken in order to observe a crystal lattice image of lamellar cementite obtained by electrolytic extraction of a wire product according to the invention. The image of (*a*) was taken under the following conditions, but any crystal lattice image did not appear.

Device: HF-2000 Electric Field Emission Transmission Electron Microscope (FE-TEM)

Total magnification: ×1,500,000 (photographing magnification×300,000)

Acceleration voltage: 200 kV

Camera length: 0.4 m

In FIG. 1, (*b*) is a diffraction pattern of the above-mentioned lamellar cementite by means of a nano probe (with a radius of an electron beam of 1.0 nm), revealing that this pattern is a halo pattern, not a ring pattern inherent to a crystal structure. From the results of (*a*) and (*b*) in FIG. 1, the lamellar cementite is found to be amorphous or amorphous-like.

(2) Mössbauer spectroscopy

Figure 2A:
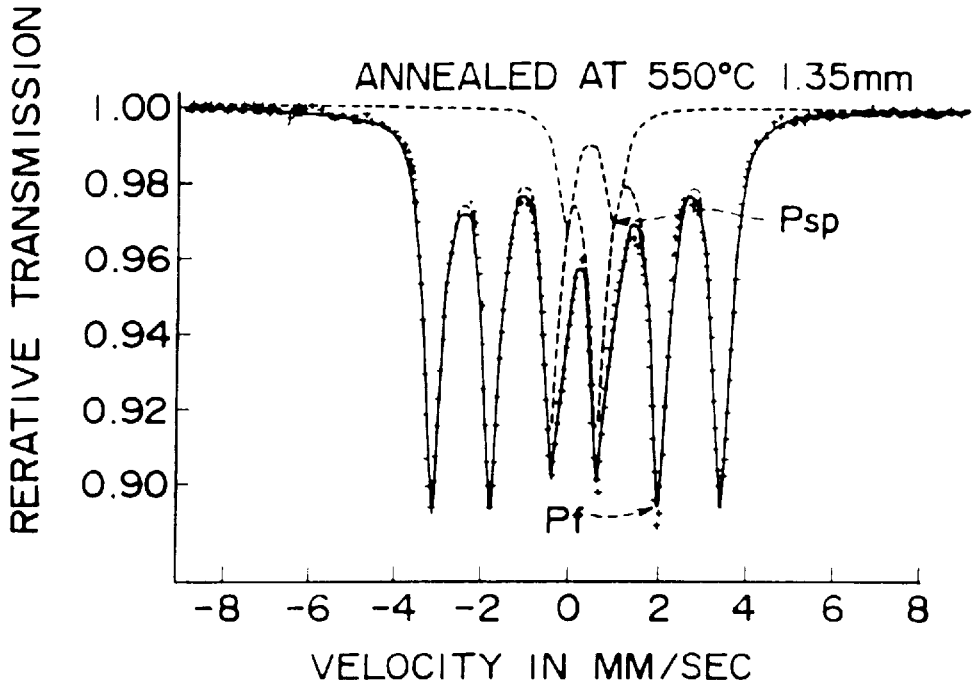
FIG. 2 is Mössbauer's spectrogram of lamellar cementite extracted from a wire product wherein spectra indicated by (*a*) are for crystalline cementite (ferromagnetic component), and spectra indicated by (*b*) and (*c*) are, respectively, for amorphized cementites (superparamagnetic components)
Figure 2B:
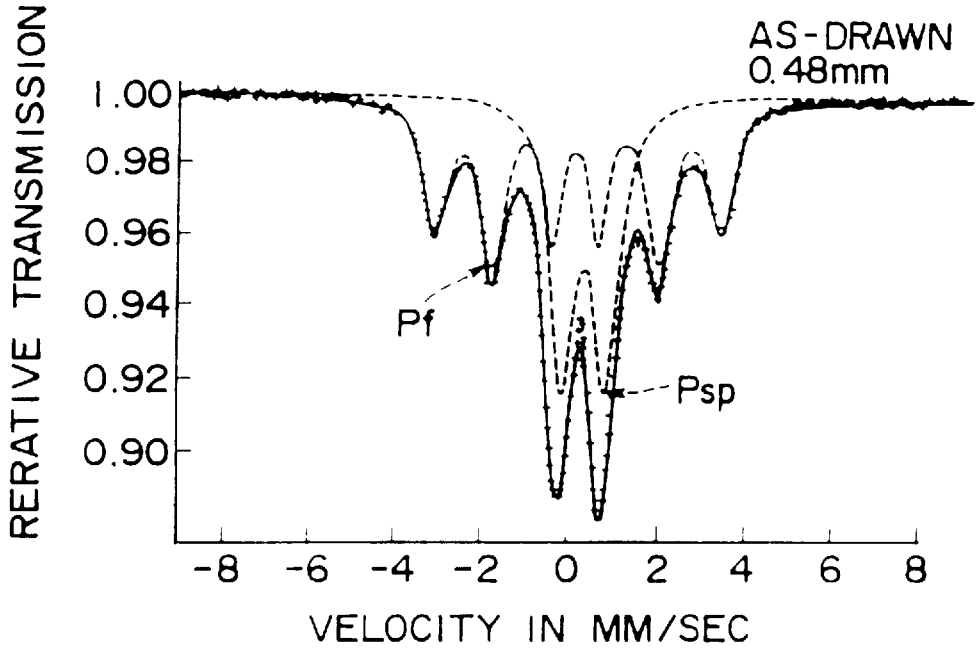
Figure 2C:
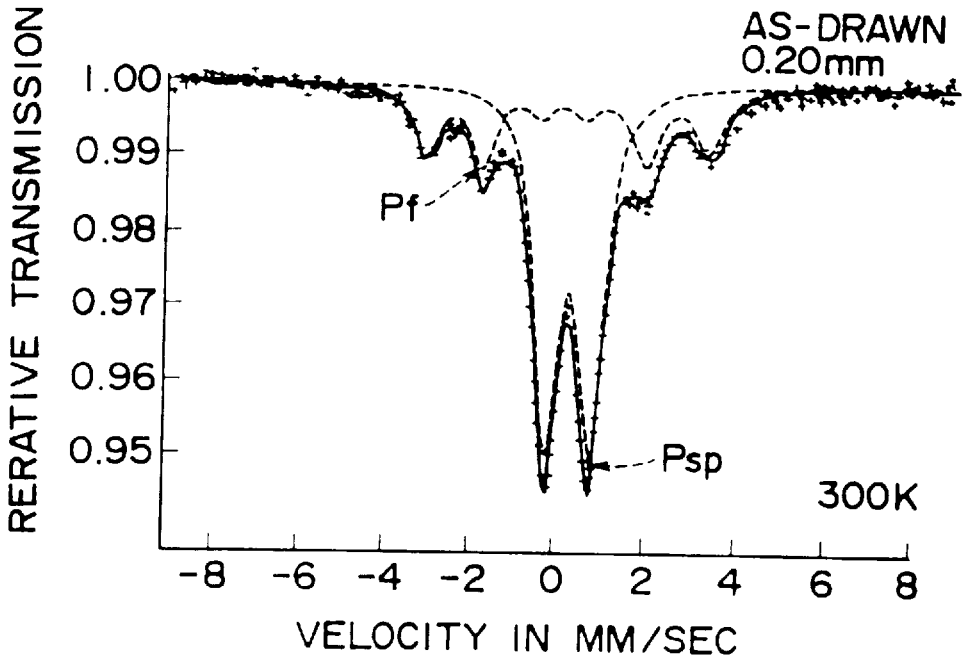

FIG. 2 shows Mössbauer spectra of lamellar cementite obtained from a residue extracted from the surface of a steel wire. The spectra indicated by (*a*), (*b*) and (*c*) are, respectively, those, of lamellar cementite obtained from a steel wire (having a diameter of 1.35 mm) prior to drawing, a steel wire (having a diameter of 0.48 mm) after drawing, and a steel wire drawn to 0.2 mm. The marks "+" plotted by the solid line are as-taken data, and the results obtained by separating peaks for every component by analysis are shown by broken lines. The broken lines obtained by the results of the analysis, respectively, show two types of ferromagnetic component and superparamagnetic component. It is known that the spectra wherein peak sextet appear (see (*a*) in FIG. 2) are for the ferromagnetic component and that the spectra wherein doublet spectrum peak appear at central portions (see (*b*) in FIG. 2) are for a superparamagnetic component. It is to be noted that a ferromagnetic material exhibits paramagnetism at a temperature higher than its Curie temperature and that when a ferromagnetic material is converted to nano crystals or an amorphous, or a structure similar thereto, it may behave paramagnetically even at normal temperatures and this behavior is called superparamagnetism.

In the practice of the invention, when a maximum value among peaks showing ferromagnetism is taken as Pf and a maximum value among peaks showing superparamagnetism is taken as Psp, and the relation of Pf<Psp is satisfied, the lamellar cementite can be judged as being amorphous or amorphous-like.

With the spectra indicated by (*a*) in FIG. 2, Pf>Psp, so that the cementite in the wire product exhibits ferromagnetism and is considered to be crystalline in nature. With the spectra of the wire drawn to an extent indicated by (*b*) in FIG. 2, a superparamagnetic component increases in amount, so that Pf<Psp. From the spectra of the wire product (with a true strain of 3.85) indicated by (*c*) in FIG. 2 which was drawn to a diameter of 0.20 mm, it will be seen that the superparamagnetic component is predominant. The wire product of (*c*) in FIG. 2 corresponds to No. 23 in Example 1 appearing hereinafter, exhibiting a good torsion characteristic.

Although there is another scientific view that spectra of an amorphous structure obtained by the Mössbauer spectroscopy are not doublet (i.e. not split into two peaks) like those spectra (*b*) and (*c*) in FIG. 2 but have a single peak, a structure showing a halo pattern by nano diffraction analysis of FE-TEM shows doublet in the Mössbauer spectra. Thus, a further scientific investigation will be necessary. Nevertheless, such a structure as mentioned above is effective one (i.e. a high strength and high toughness structure) in the practice of the invention. Accordingly, those structures including a structure which shows doublet Mössbauer spectra (superparamagnetic spectra) are judged as an amorphous or amorphous-like structure defined in the present invention.

As stated hereinbefore, it can be quantitatively judged that when a maximum value among peaks showing a ferromagnetic component is taken as Pf and a maximum value among peaks showing a superparamagnetic component is taken as a superparamagnetic component in the Mössbauer spectra of lamellar cementite, to satisfy the relation of Pf<Psp (Psp/Pf≧1) indicates an amorphous or amorphous-like structure. More preferably, Psp/Pf≧4, and most preferably, Psp/Pf≧5.

(3) X-ray diffraction analysis

When the half width (2 θ) of a maximum peak in the X-ray diffraction pattern of the lamellar cementite or cementite is 3 rad., or above, such a structure can be judged as being amorphous or amorphous-like.

Figure 4:
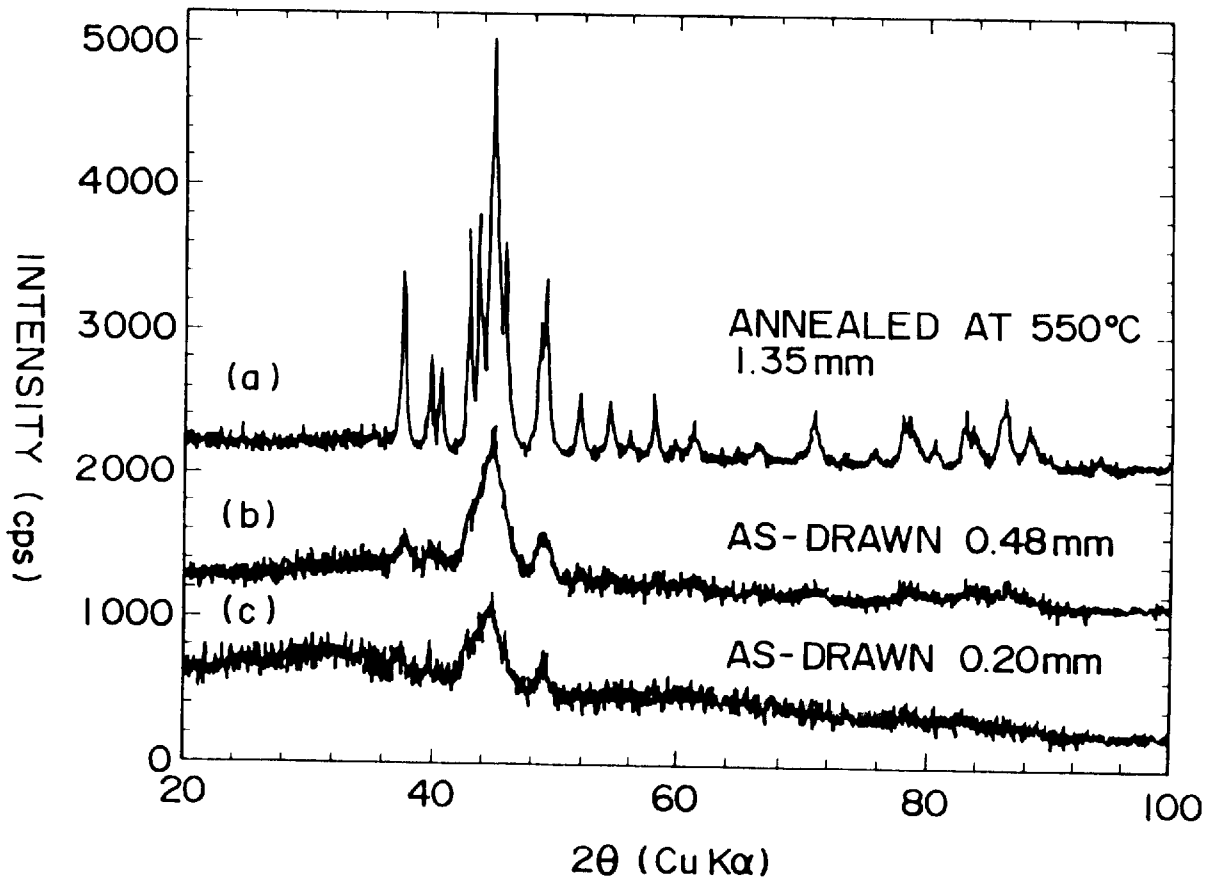
FIG. 4 is an X-ray diffraction pattern of lamellar cementite extracted from a wire product wherein a pattern indicated by (*a*) is for crystalline cementite, and patterns indicated by (*b*) and (*c*) are, respectively, for amorphized cementites.

FIG. 4 shows the results of an X-ray measurement of an extraction residues of a wire product, corresponding to No. 23 of Example 1 appearing hereinafter, (*a*) prior to drawing, (*b*) after drawing (1.35 mm reduced to 0.48 mm) and (*c*) after drawing (0.48 mm reduced to 0.20 mm). As the drawing proceeds from (*a*) to (*c*), the peak at about 45 rad., inherent to cementite reduces, with the tendency that the peak is broadened. It will be noted that in the case of the wire product indicated by (*c*) in FIG. 4 and having a true strain of 3.58 (wire size: 0.20 mm), the peak does not disappear completely, suggesting that part of the crystals remains.

The amorphousness in the measurement with an X-ray means the absence of any peak. Like the spectra (*c*) in FIG. 4, a state where a peak does not disappear completely and crystallinity is, more or less, left is called "amorphous-like"

herein. In the practice of the invention, when a maximum peak (e.g. a peak at about 45 rad., for cementite) in the X-ray diffraction pattern is broad with its half width being 3 rad., or above, this structure is judged as amorphous or amorphous-like. The half width is sufficient to be 3 rad., or above in order to obtain a wire product having a good torsion characteristic, and is preferably 5 rad., or above and most preferably, 7 rad., or above.

It is known that when drawn, a surface portion corresponding to ¼ to ⅕ of the diameter from the outer surface and an interior central portion make a difference in texture therebetween. In other words, the crystal orientations differ between the surface portion and the central portion. It is considered that when a torsion test or the like test is effected, an internal stress develops in the vicinity of the boundary between the surface portion and the central portion owing to the difference in texture, resulting in the delamination involved in the boundary. Accordingly, when a peripheral portion including, at least, the vicinity of the boundary between the surface portion and the central portion is amorphous or amorphous-like, it is expected to show a good torsion properties. Nevertheless, in order to ensure an excellent torsion property, it is preferred that an entire wire product including the central portion should be amorphous or amorphous-like.

Figure 3A:
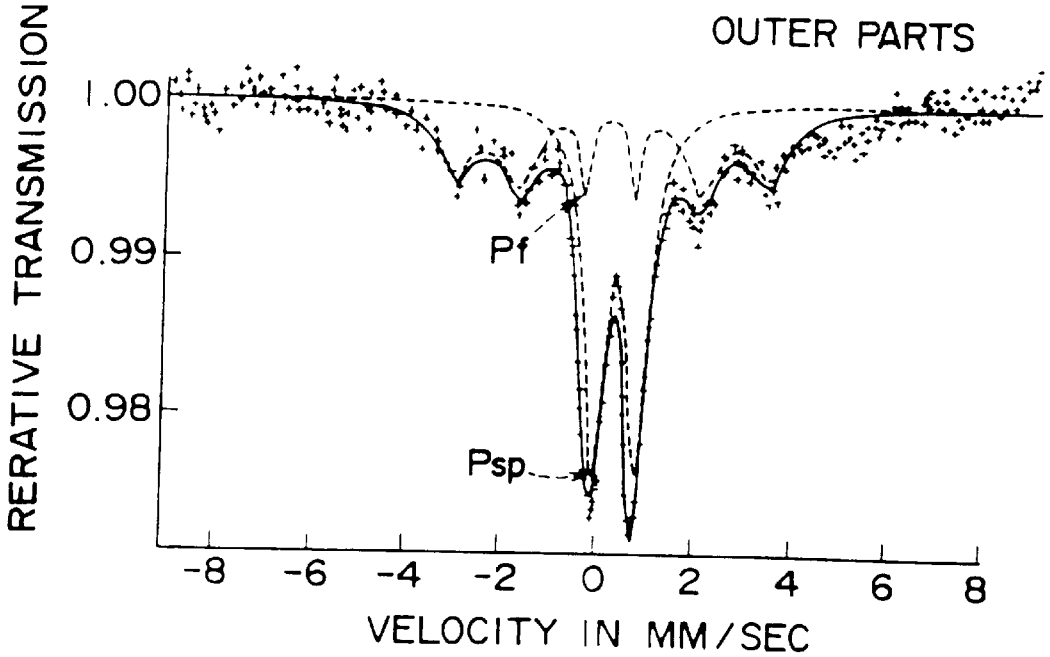
FIG. 3 is Mössbauer's spectrogram of lamellar cementite extracted from a wire product wherein spectra indicated by (*a*) is for a surface layer portion and spectra indicated by (*b*) is for a central portion.
Figure 3B:
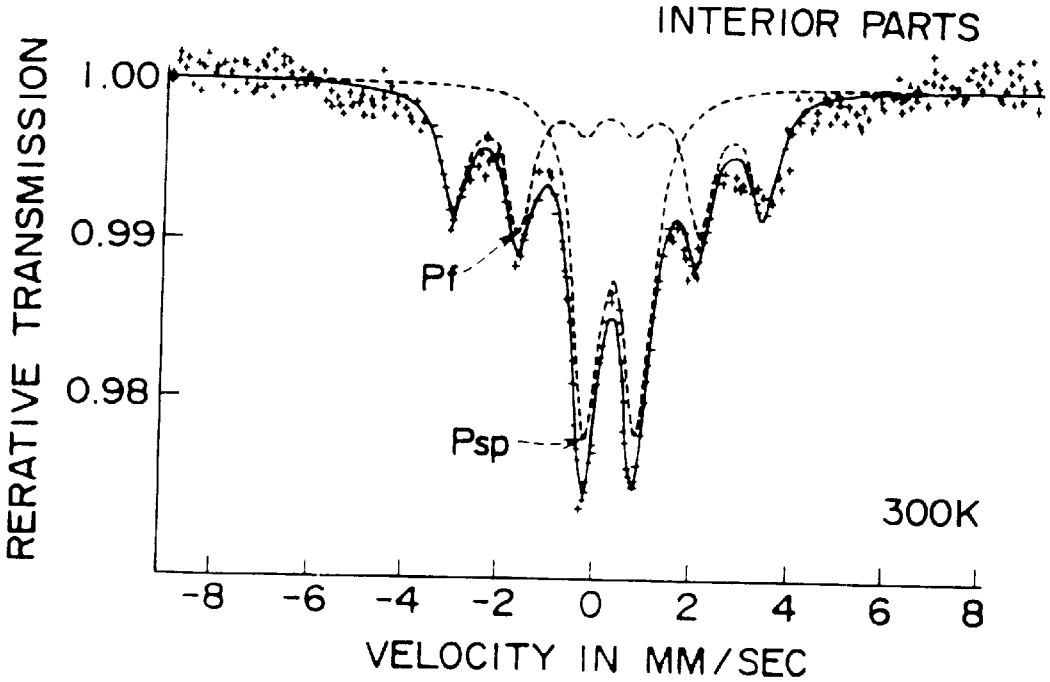

FIG. 3 shows the results of an experiment which was conducted for the purpose of comparing Mössbauer spectra of cementite between the surface portion and the central portion of a wire product whose true strain is 3.85 (with a wire diameter of 0.2mm). The spectra indicated by (*a*) and (*b*) are, respectively, those of cementite structures obtained from residues which were extracted from the surface portion and the central portion. These spectra reveal that although a ferromagnetic component is left in relatively large amounts at the central portion with a small degree of amorphization, both portions satisfy the relation of Pf<Psp and that the peaks of the ferromagnetic and superparamagnetic components are both very high, giving evidence that there is little difference between the portions. In the practice of the invention, where the TEM observation or the Mössbauer spectroscopy is carried out for the analysis of lamellar cementite, a sample from a surface portion may be used.

As having described hereinabove, the carbide in the structure of a steel wire is rendered amorphous or amorphous-like, by which there can be obtained a high strength and high toughness steel wire. When this wire is used as an as-drawn wire without subjecting any thermal treatments such as blueing, it is optimum as a material for steel cord wires, PC steel wires, spring steel wires, wire saws and the like.

The invention is described in more detail by way of examples should not be construed as limiting the invention thereto. It is obvious that many changes and modifications can be made in the above description and the departing from the spirit of departing from the spirit of the invention.

EXAMPLE 1

Three types of high carbon steels which, respectively, had C contents of 0.97% (Cr: 0.22%), 0.92% (Cr: 0.21%), and 0.82% (Cr: 0) with other constituents being same (Si: 0.2%, Mn: 0.5%, P: 0.004%, S: 0.003%, and the balance being Fe). The steels were each hot rolled into a steel wire having a diameter of 5.5 mm, followed by repeating patenting and cold drawing steps to obtain a steel wire having a diameter of 1.3 mm. Subsequently, the wire was subjected to final patenting at 550° C. and drawn to a final diameter shown in Table 2.

The crystal state of a carbide (lamellar cementite) in the resulting steel wires was observed through a transmission electron microscope, and the mechanical properties of the wires were measured. The results are shown in Table 2.

TABLE 2

| | Constituent (%) | | Wire Size | Cooling at the Time of | TEM Diffraction | Yield Point (MPa) | Tensile Strength (MPa) | Reduction of Area (%) | Number of Torsion | TS × (RA + TN) |
|---|---|---|---|---|---|---|---|---|---|---|
| No. | C | Cr | (mm) | Drawing | Pattern | YP | TS | RA | YN | (GPa) |
| 21 | 0.97 | 0.22 | 0.18 | yes | hallo | 4098 | 4234 | 38 | 36.0 | 313.2 |
| 22 | 0.97 | 0.22 | 0.19 | yes | hallo | 3964 | 4108 | 39 | 37.5 | 314.2 |
| 23 | 0.97 | 0.22 | 0.20 | yes | hallo | 3924 | 4098 | 40 | 37.0 | 315.5 |
| 24 | 0.97 | 0.22 | 0.20 | no | ring | 3918 | 4054 | 35 | 34.5 | 281.7 |
| 25 | 0.97 | 0.22 | 0.19 | no | ring | 3978 | 4103 | 31 | 0 | 127.1 |
| 26 | 0.92 | 0.18 | 0.21 | yes | hallo | 3647 | 3809 | 42 | 34.5 | 291.3 |
| 27 | 0.92 | 0.18 | 0.19 | yes | hallo | 3569 | 3798 | 43 | 40.0 | 315.2 |
| 28 | 0.92 | 0.18 | 0.20 | yes | hallo | 3514 | 3765 | 44 | 40.5 | 318.1 |
| 29 | 0.92 | 0.18 | 0.20 | no | ring | 3467 | 3698 | 39 | 36.5 | 279.1 |
| 30 | 0.92 | 0.18 | 0.19 | no | ring | 3642 | 3791 | 38 | 0 | 144.0 |
| 31 | 0.82 | 0 | 0.18 | yes | hallo | 3056 | 3346 | 48 | 43.0 | 304.4 |
| 32 | 0.82 | 0 | 0.19 | yes | hallo | 3007 | 3286 | 49 | 43.5 | 303.9 |
| 33 | 0.82 | 0 | 0.20 | yes | hallo | 2997 | 3269 | 50 | 44.5 | 308.9 |
| 34 | 0.82 | 0 | 0.20 | no | ring | 2916 | 3215 | 48 | 42.0 | 289.3 |
| 35 | 0.82 | 0 | 0.19 | no | ring | 3048 | 3245 | 46 | 0 | 149.2 |

(All steels contain, aside from C and Cr, 0.2% Si, 0.5% Mn, 0.04% P, 0.003% S and the balance of Fe.)

In all the cases of the three types of high carbon steels which were drawn while cooling, lamellar cementite was amorphized. All of the sample Nos. 21 to 23, 26 to 28 and 31 to 33 wherein the carbide was amorphized have a value of [TS×(RA+TN)] of 290 or above. On comparison with sample Nos. 24. 25. 29, 30, 34 and 35 wherein the carbide consisted of nano crystals, mechanical characteristics such as strength and toughness are better.

Especially, with sample Nos. 25, 30 and 35, the value of torsion (100 dia.) was 0 because of the formation of delaminations.

EXAMPLE 2

In the same manner as in Example 1, steel wires were made except that a true torsion, a drawing method and an average reduction of area and a drawing rate was changed as shown in Table 3.

TABLE 3

| No. | Initial Diameter of Wire (mm) | Final Diameter of Wire (mm) | True strain | Drawing Method | Average Reduction of Area (%) | Drawing Rate (m/minute) | Crystal Structure of Cementite |
|---|---|---|---|---|---|---|---|
| 41 | 1.2 | 1.2 | 0 | no | as-patented | — | single crystal |
| 42 | 2.0 | 0.2 | 4.61 | wet | 15 | 500 | amorphous/amorphous-like |
| 43 | 1.2 | 0.2 | 3.58 | wet | 15 | 500 | amorphous/amorphous-like |
| 44 | 0.6 | 0.2 | 2.20 | wet | 15 | 500 | amorphous/amorphous-like |
| 45 | 0.6 | 0.2 | 2.20 | wet | 15 | 1200 | nano structure |
| 46 | 0.5 | 0.2 | 1.83 | wet | 15 | 500 | nano structure |
| 47 | 0.4 | 0.2 | 1.39 | wet | 20 | 500 | nano structure |
| 48 | 5.0 | 1.0 | 3.22 | dry | 15 | 500 | nano structure |

Sample Nos. 42 to 44, respectively, have a true strain of 2.0 or above and are made by wet drawing at appropriate average reduction of area and drawing speed. Thus, amorphized cementite is obtained. Sample Nos. 45 to 48 are for comparison wherein No. 45 is made at too high a drawing speed, No. 46 has too small a true strain, No. 47 is too high in average reduction of area, and No. 48 is not cold drawn. In all the cases, cementite has a nano structure and is not amorphized.

EXAMPLE 3

Sample Nos. 21 to 35 obtained in Example 1 were each subjected to Mössbauer spectroscopy and X-ray diffraction analysis. The Mössbauer spectroscopy was effected according a transmission geometry using a 0.92 GBq $^{57}$Co source. The results are shown in table 4.

TABLE 4

| No. | Tensile Strength (MPa) TS | Reduction of Area (%) RA | Number of Torsion TN | TS × (RA + TN) (GPa) | Mössbauer Peak Ratio Psp/Pf | Half Width of X-ray Diffraction (2 θ) | Crystal State |
|---|---|---|---|---|---|---|---|
| 21 | 4234 | 38 | 36.0 | 313.3 | 5.38 | 7.2 | amorphous/amorphous-like |
| 22 | 4108 | 39 | 37.5 | 314.2 | 5.24 | 6.8 | amorphous/amorphous-like |
| 23 | 4098 | 40 | 37.0 | 315.5 | 3.93 | 4.9 | amorphous/amorphous-like |
| 24 | 4054 | 35 | 34.5 | 281.7 | 0.24 | 2.4 | crystal-like |
| 25 | 4103 | 31 | 0 | 127.1 | 0.25 | 2.3 | crystal-like |
| 26 | 3809 | 42 | 34.5 | 291.3 | 5.28 | 7.6 | amorphous/amorphous-like |
| 27 | 3798 | 43 | 40.0 | 315.2 | 5.19 | 7.1 | amorphous/amorphous-like |
| 28 | 3765 | 44 | 40.5 | 318.1 | 4.62 | 5.2 | amorphous/amorphous-like |
| 29 | 3698 | 39 | 36.5 | 279.1 | 0.38 | 2.1 | crystal-like |
| 30 | 3791 | 38 | 0 | 144.0 | 0.41 | 2.2 | crystal-like |
| 31 | 3346 | 48 | 43.0 | 304.4 | 5.29 | 7.4 | amorphous/amorphous-like |
| 32 | 3286 | 49 | 43.5 | 303.9 | 5.31 | 6.9 | amorphous/amorphous-like |
| 33 | 3269 | 50 | 44.5 | 308.9 | 4.61 | 5.1 | amorphous/amorphous-like |
| 34 | 3215 | 48 | 42.0 | 289.3 | 0.33 | 2.1 | crystal-like |
| 35 | 3245 | 46 | 0 | 149.2 | 0.26 | 2.2 | crystal-like |

Sample Nos. 21 to 23, 26 to 28 and 31 to 33 which, respectively, have a value of [TS×{RA+TN}] of 290 or above and a good torsion properties have a Psp/Pf value of 1.0 or above, i.e. Pf<Psp, wherein Pf is a maximum value among peaks for a ferromagnetic component and Psp is a maximum value among peaks for a superparamagnetic component in the Mössbauer spectra of cementite. The half width (2 θ) of the maximum peak in the X-ray diffraction analysis is 3 rd., or above.

As will be apparent from the foregoing, the steel wire of the invention is more unlikely to cause any delamination and better in strength and toughness than steel wires of the type where carbide consists of nano crystals.

What is claimed is:

1. A high strength and high toughness steel wire comprising fine pearlite or coarse pearlite as a main component, wherein lamellar cementite in a structure thereof is amorphous.

2. A high strength and high toughness steel wire comprising bainite as a main component, wherein lamellar cementite in a structure thereof is amorphous.

3. A high strength and high toughness steel wire according to claim 1, wherein when said lamellar cementite is subjected to observation through a transmission electron microscope, a diffraction pattern obtained at a beam diameter of 1 nm or below consists of a halo pattern and any crystallinity is not confirmed from a lattice image.

4. A high strength and high toughness steel wire according to claim 2, wherein when said cementite is subjected to observation through a transmission electron microscope, a diffraction pattern obtained at a beam diameter of 1 nm or below consists of a halo pattern and any crystallinity is not confirmed from a lattice image.

5. A high strength and high toughness steel wire according to claim 1, wherein when said lamellar cementite is subjected to Mössbauer spectroscopy, the relation of Pf<Psp is satisfied, in which Pf represents a maximum value among peaks exhibiting a ferromagnetic component and Psp represents a maximum value among peaks exhibiting a superparamagnetic component in the Mössbauer spectra.

6. A high strength and high toughness steel wire according to claim 2, wherein when said cementite is subjected to M össbauer spectroscopy, the relation of Pf<Psp is satisfied, in which Pf represents a maximum value among peaks exhibiting a ferromagnetic component and Psp represents a maximum value among peaks exhibiting a superparamagnetic component in the Mössbauer spectra.

7. A high strength and high toughness steel wire according to claim 1, wherein when said lamellar cementite is subjected to X-ray diffraction analysis, a half width (2 θ) at a maximum peak of the resultant X-ray diffraction pattern is not smaller than 3 rad.

8. A high strength and high toughness steel wire according to claim 2, wherein when said cementite is subjected to X-ray diffraction analysis, a half width (2 θ) at a maximum peak of the resultant X-ray diffraction pattern is not smaller than 3 rad.

9. A method for making a high strength and high toughness steel wire defined in claim 1, the method comprising repeating patenting and cold drawing steps plural times, and subjecting the resultant wire to final drawing at a true strain of 2.0 or above while cooling.

10. A method for making a high strength and high toughness steel wire defined in claim 2, the method comprising repeating patenting and cold drawings steps plural times, and subjecting the resultant wire to final drawing at a true strain of 2.0 or above while cooling.

* * * * *